US008967642B2

(12) United States Patent
Bagheri

(10) Patent No.: US 8,967,642 B2
(45) Date of Patent: Mar. 3, 2015

(54) WALKER

(71) Applicant: Kourosh Bagheri, Shell Beach, CA (US)

(72) Inventor: Kourosh Bagheri, Shell Beach, CA (US)

(73) Assignee: Entropy Enterprises, LLC, Shell Beach, CA (US)

( * ) Notice: Subject to any disclaimer, the term of this patent is extended or adjusted under 35 U.S.C. 154(b) by 0 days.

(21) Appl. No.: 13/839,848

(22) Filed: Mar. 15, 2013

(65) Prior Publication Data

US 2014/0265199 A1 Sep. 18, 2014

(51) Int. Cl.
*A47D 13/04* (2006.01)
*A61G 5/10* (2006.01)
*A61G 5/14* (2006.01)

(52) U.S. Cl.
CPC ..... *A61G 5/1002* (2013.01); *A61G 5/10* (2013.01); *A61G 5/14* (2013.01)
USPC ..... 280/87.041; 135/67; 135/74; 297/5

(58) Field of Classification Search
USPC ..... 280/87.041; 135/67, 69, 74, 75; 297/5–6; 188/29
See application file for complete search history.

(56) References Cited

U.S. PATENT DOCUMENTS

| | | | | |
|---|---|---|---|---|
| 3,778,052 | A | 12/1973 | Andow | |
| 4,272,071 | A | 6/1981 | Bolton | |
| 4,342,465 | A | 8/1982 | Stillings | |
| 4,770,410 | A | 9/1988 | Brown | |
| 4,941,497 | A | 7/1990 | Prather | |
| 5,040,556 | A | 8/1991 | Raines | |
| 5,083,806 | A | 1/1992 | Brown | |
| 5,112,044 | A | 5/1992 | Dubats | |
| 5,123,665 | A * | 6/1992 | Levy | 280/35 |
| 5,228,708 | A | 7/1993 | Verdugo | |
| 5,255,697 | A | 10/1993 | Grauer | |
| 5,324,064 | A | 6/1994 | Sumser | |
| 5,476,432 | A | 12/1995 | Dickens | |
| 5,564,136 | A | 10/1996 | Cox | |
| 5,601,302 | A | 2/1997 | Beard | |
| 5,813,948 | A | 9/1998 | Quigg | |
| 6,527,285 | B1 | 3/2003 | Calandro, II | |
| 6,733,018 | B2 | 5/2004 | Razon | |
| 6,742,523 | B2 | 6/2004 | Dubats | |
| 8,162,333 | B1 * | 4/2012 | Bartlett | 280/87.05 |
| 2005/0082886 | A1 * | 4/2005 | Sganga | 297/219.1 |
| 2005/0183759 | A1 | 8/2005 | Wolfe | |
| 2007/0163633 | A1 | 7/2007 | Gale | |

* cited by examiner

*Primary Examiner* — Jeffrey J Restifo
*Assistant Examiner* — Erez Gurari
(74) *Attorney, Agent, or Firm* — Fitch, Even, Tabin & Flannery LLP

(57) ABSTRACT

An apparatus having an upper frame adapted to at least partially encircle a person; a lower frame; a scissor mechanism for coupling the upper frame to the lower frame, wherein the distance between the upper frame and the lower frame can be varied by adjusting the scissor mechanism; and a telescoping rod coupled to the scissor mechanism for locking the scissor mechanism, wherein the distance between the upper frame and the lower frame is locked by the telescoping rod.

8 Claims, 10 Drawing Sheets

WALKER

BACKGROUND OF THE INVENTION

1. Field of the Invention

The present invention relates generally to an adult walker for assisting the disabled or those who have difficulty ambulating and, more specifically, with an adult walker for seated or standing use. Even more specifically, this invention relates to an adult walker with provisions for incontinent persons.

2. Discussion of the Related Art

Adult walkers and wheelchairs are known in the art which assist the mobility of persons, such as the elderly or disabled, who are unable to walk or move around without assistance. These devices have improved the range of activity of such persons under conditions where available assistance by personnel is limited. A person requiring mobility assistance may also be incontinent, dictating a device which both provides mobility and security while accommodating incontinence needs and providing for the comfort of the user.

Wheelchairs are one method of providing mobility, and the prior art includes wheelchair commodes for use by incontinent persons. However, since the wheelchair provides no exercise or movement for legs, these muscles will atrophy more quickly and ultimately diminish the physical strength of the patient.

Various types of adult walkers are commonly used by elderly or disabled persons who have the capability of supporting their weight on their legs and walking, but cannot do so unassisted because of a tendency to stumble or fall. For example, elderly persons who reside in long-term care facilities frequently have a great need to exercise and to convey themselves from one location to another, but are afraid to do so without the assistance of an aid.

A wide variety of adult walkers have been devised for elderly or disabled persons. Adult walkers typically consist of a rigid frame supported on the floor. Numerous frame variations are found in the art. For the more ambulatory, the adult walker legs rest directly on the floor. The person lifts the frame, extends it forward with his arms, and walks for one or more steps before lowering the frame to the floor. Other frame variations incorporate a combination of wheels and legs so that the adult walker may be tilted and rolled forward. For the less ambulatory, the adult walker may be supported solely by three or more wheels, and the person need only apply a lateral force to move the walker. Tipping can be a hazard, especially since the elderly or disabled may have limited balance. Depending on the number and location of wheels and/or legs, the adult walker may fail to provide sufficient lateral support against tipping, especially if the person is overweight.

Most adult walkers are vertically adjustable so that users of different sizes and/or needs can be accommodated. Commonly the adjustment is provided by a type of telescoping leg.

Adult walkers may have an enclosed design with a moveable portion that allows the person to enter or exit when open while providing additional support and security in the closed position. Alternately, the adult walker may have an open front or back that allows for support while providing ease of entry and exit.

Some adult walkers have a seat or sling. This allows the walker to fully support the person in a seated position and may also be used to prevent falls. The support may be integral or removable. Some adult walkers have a strap or multiple straps to assist in securing the person and preventing falls.

Another feature of some adult walkers is a foldable design or a design that allows for easy disassembling. This allows the walker to be more easily transported or stored.

Persons using adult walkers may have need of additional medical equipment while using the walker. Some walkers are equipped with support or attachment devices for medical equipment such as IV bags or medication dispensers. However, walker designs to accommodate incontinence are not found in the prior art, even though persons requiring walker use may be incontinent as well.

SUMMARY OF THE INVENTION

Several embodiments of the invention advantageously address the needs above as well as other needs by providing an adult walker for seated or standing use.

In one embodiment, the invention can be characterized as an apparatus comprising an upper frame adapted to at least partially encircle a person; a lower frame; a scissor mechanism for coupling the upper frame to the lower frame, wherein the distance between the upper frame and the lower frame can be varied by adjusting the scissor mechanism; and a telescoping rod coupled to the scissor mechanism for locking the scissor mechanism, wherein the distance between the upper frame and the lower frame is locked by the telescoping rod.

BRIEF DESCRIPTION OF THE DRAWINGS

The above and other aspects, features and advantages of several embodiments of the present invention will be more apparent from the following more particular description thereof, presented in conjunction with the following drawings.

Figure 1:
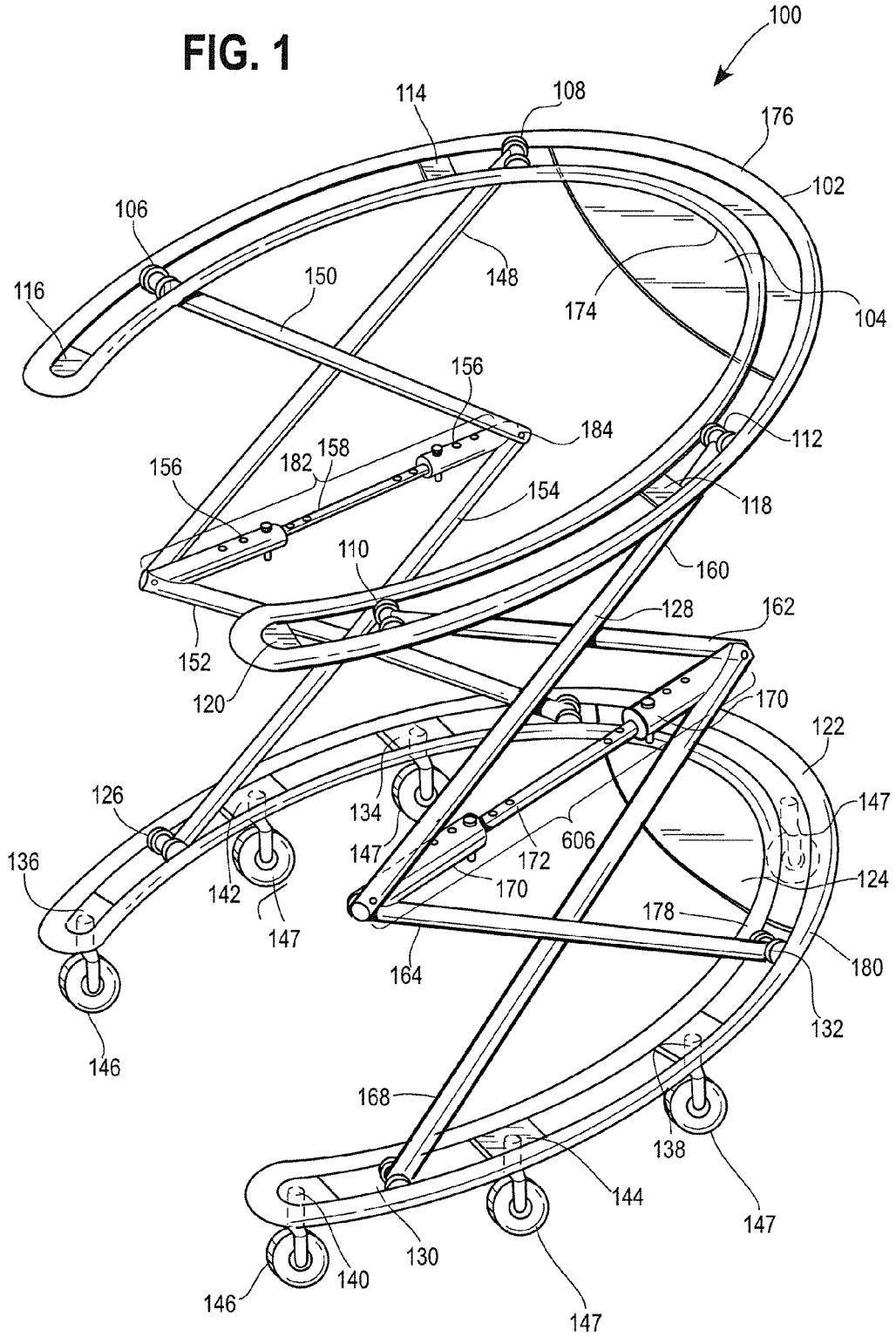
FIG. 1 is a perspective view of an adult walker frame.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Referring first to FIG. 1, an adult walker 100 in one embodiment of the invention is shown. The top portion of the adult walker 100 includes a top horseshoe 102, a top front plate 104, a left top rear pivot attachment 106, a left top front pivot attachment 108, a right top rear pivot attachment 110, a right top front pivot attachment 112, a left top front plate 114, a left top rear plate 116, a right top front plate 118, and a right top rear plate 120. The bottom portion of the adult walker 100 includes a bottom horseshoe 122, a bottom front plate 124, a left bottom rear pivot attachment 126, a left bottom front pivot attachment 128, a right bottom rear pivot attachment 130 and a right bottom front pivot attachment 132, a left bottom front plate 134, a left bottom rear plate 136, a right bottom front plate 138, a right bottom rear plate 140, a left bottom middle plate 142, a right bottom middle plate 144, a plurality of locking wheels 146, and a plurality of non-locking wheels 147. Joining the top and bottom horseshoes 102, 122 on the left side are a top left outer rod 148, a top left inner rod 150, a bottom left outer rod 152, a bottom left inner rod 154, a plurality of left outer tubes 156, and a left inner tube 158. Joining the top and bottom horseshoes 102, 122 on the right side are a top right outer rod 160, a top right inner rod 162, a bottom right outer rod 164, a bottom right inner rod 168, a plurality of right outer tubes 170, and a right inner tube 172.

The top horseshoe 102 in one embodiment of the invention is made of ¼ inch solid aluminum rods which form the a top inner horseshoe rail 174 and a top outer horseshoe rail 176. Each horseshoe rail 174, 176 is formed in a horseshoe shape, with the top horseshoe rails 174, 176 running parallel with an approximately 2 inches clear distance between the rails. The top horseshoe rails are joined at the horseshoe shape ends so that the top horseshoe rails 174, 176 are continuous. The top horseshoe rails 174, 176 at the horseshoe shape ends form an arc. The front of the adult walker 100 is designated as the location of the midpoint of the horseshoe shape, and the rear of the adult walker 100 is designated as the location of the horseshoe ends. The length of the top horseshoe 102 in this embodiment is approximately 36" measured along the line of symmetry of the top horseshoe 102. The top front plate 104 in a pointed oval shape is coupled to the underside of the front portion of the top horseshoe 102. The top front plate 104 is made of aluminum or other suitable material. The top front plate 104 is oriented so that the front curved edge of the top front plate 104 aligns with the front edge of the top horseshoe 102. The left top front plate 114 approximately 2.5 inches× 2.5 inches is coupled to the underside of the top horseshoe 102 at approximately a one-third point along the left side of the top horseshoe 102, starting at the front of the top horseshoe 102. The right top front plate 118 approximately 2.5 inches×2.5 inches is coupled to the underside of the top horseshoe 102 at approximately a one-third point along the right side of the top horseshoe 102, starting at the front of the top horseshoe 102. The left and right top front plates 114, 118 are made of aluminum or other suitable material. The left top rear plate 116 approximately 2.5 inches×2.5 inches is coupled to the underside of the top horseshoe 102 so that one side of the plate aligns with the left end of the top horseshoe 102. The right top rear plate 120 approximately 2.5 inches×2.5 inches is coupled to the underside of the top horseshoe 102 so that one side of the plate aligns with the right edge of the top horseshoe 102. The left and right top rear plates 116, 120 are made of aluminum or other suitable material. The left top rear pivot attachment 106 is shown on the left side of the top horseshoe 102 near the top horseshoe's left end. The left top front pivot attachment 108 is shown on the left side of the top horseshoe 102 near the left edge of the top front plate 104. The left top pivot attachments 106, 108 span horizontally between the parallel top horseshoe rails 174, 176. The right top rear pivot attachment 110 is shown on the right side of the top horseshoe 102 near the horseshoe's right end. A right top front pivot attachment 112 is shown on the right side of the top horseshoe 102 near the right edge of the top front plate 104. The right top pivot attachments 110, 112 span horizontally between the parallel top horseshoe rails 174, 176. The pivot attachments are described in more detail below.

The bottom horseshoe 122 in one embodiment of the invention is made of ¼ inch solid aluminum rods which form the bottom inner horseshoe rail 178 and bottom outer horseshoe rail 180. Each horseshoe rail 178, 180 is formed in a horseshoe shape, with the bottom horseshoe rails 178, 180 running parallel with an approximately 2 inch clear distance between the rails. The bottom horseshoe rails are joined at the horseshoe shape ends so that the bottom horseshoe rails 178, 180 are continuous. The bottom horseshoe rails 178, 180 at the horseshoe shape ends form an arc. The length of the bottom horseshoe 122 in this embodiment is approximately 36 inches measured along the line of symmetry of the bottom horseshoe 122. The bottom front plate 124 in a pointed oval shape is coupled to the underside of the front portion of the bottom horseshoe 122. The bottom front plate 124 is made of aluminum or other suitable material. The bottom front plate 124 is oriented so that the front curved edge of the bottom front plate 124 aligns with the front edge of the bottom horseshoe 122. The left bottom rear pivot attachment 126 is shown on the left side of the bottom horseshoe 122 near the horseshoe's left end. The left bottom front pivot attachment 128 is shown on the left side of the bottom horseshoe 122 near the left edge of the bottom front plate 124. The left bottom pivot attachments 126, 128 span horizontally between the bottom horseshoe rails 178, 180. The right bottom rear pivot attachment 130 is shown on the right side of the bottom horseshoe 122 near the horseshoe's right end. The right bottom front pivot attachment 132 is shown on the right side of the bottom horseshoe 122 near the right edge of the bottom front plate 124. The right bottom pivot attachments 130, 132 span horizontally between the bottom horseshoe rails 178, 180. The six bottom plates 134, 136, 138, 140, 142, 144 are shown coupled to the underside of the bottom horseshoe 122. The bottom plates 134, 136, 138, 140, 142, 144 are made of aluminum or other suitable material and are sized to provide secure attachment to the underside of the bottom horseshoe rails 178, 180 and also to provide sufficient area for wheel attachment. The left and right bottom rear plates 136, 140 are located at the left and right ends of the bottom horseshoe 122, respectively. The left and right bottom middle plates 142, 144 are located approximately halfway between the front and rear of the walker frame. The left and right bottom front plates 134, 136 are approximately equidistant the middle wheel, with sufficient clearance given for the adjacent front pivot attachment.

The top horseshoe 102 and the bottom horseshoe 122 are connected vertically on each side by the series of adjustment rods 148, 150, 152, 154, 160, 162, 164, 168. These rods 148, 150, 152, 154, 160, 162, 164, 168 provide vertical support of the top horseshoe 102 and vertical adjustment of the height of the top horseshoe 102. On each side of the walker 100, the adjustment rods 148, 150, 152, 154, 160, 162, 164, 168 form a vertical double-X shape, with one X on top of the other X. The double-X, also referred to as a scissor mechanism, extends on the left side from the left side of the top horseshoe 102 to the left side of the bottom horseshoe 122. The left top X is formed by the left top outer rod 148 and the left top inner rod 150. The top end of the left top outer rod 148 is coupled to the left top front pivot attachment 108 so that the left top outer rod 148 may pivot or rotate in a vertical plane. The left top outer rod 148 extends diagonally downward and to the rear. The top end of the left top inner rod 150 is coupled to the left top rear pivot attachment 106 so that the left top inner rod 150 may pivot or rotate in a vertical plane. The left top inner rod 150 extends diagonally downward and to the front. The left bottom X is formed by the left bottom outer rod 152 and the left bottom inner rod 154. The bottom end of the left top outer rod 148 is coupled to the top end of the left bottom outer rod 152 so that the outer rods 148, 152 may rotate in the same plane. The bottom end of the left bottom outer rod 152 is coupled to the left bottom front pivot attachment 128 so that the left bottom outer rod 152 may rotate or pivot in a vertical plane. The bottom end of the left top inner rod 150 is coupled to the top end of the left bottom inner rod 154 so that the left bottom inner rods 150, 154 may rotate in the same plane. The bottom end of the left bottom inner rod 154 is coupled to the left bottom rear pivot attachment 126 so that the left bottom inner rod 154 may rotate or pivot in a vertical plane. Where the top X connects to the bottom X, a left horizontal telescoping adjustment tube 182 joins the front side of the X to the rear side of the X. The left telescoping adjustment tube 182 is comprised of the two left outer tubes 156 and the left inner tube 158. One left outer tube 156 is located at each end of the left inner tube 158 so that the outer tubes 156 may slide over the ends of the inner tube 158, lengthening or shortening the left telescoping adjustment tube 182. The left telescoping adjustment tube 182 is connected to a plurality of rod pivot points 184 so that the inner and outer rods 148, 150, 152, 154 may rotate or pivot relative to the left telescoping adjustment tube 182. The rotation of the inner and outer rods 148, 150, 152, 154 raises and lowers the top horseshoe 102. The left telescoping adjustment tube 182 provides additional stability to the vertical adjustment and locks the top horseshoe 102 height in place. The operation of the vertical adjustment is described in more detail below. The vertical adjustment system as previously described is repeated on the right hand side of the adult walker 100.

Figure 2:
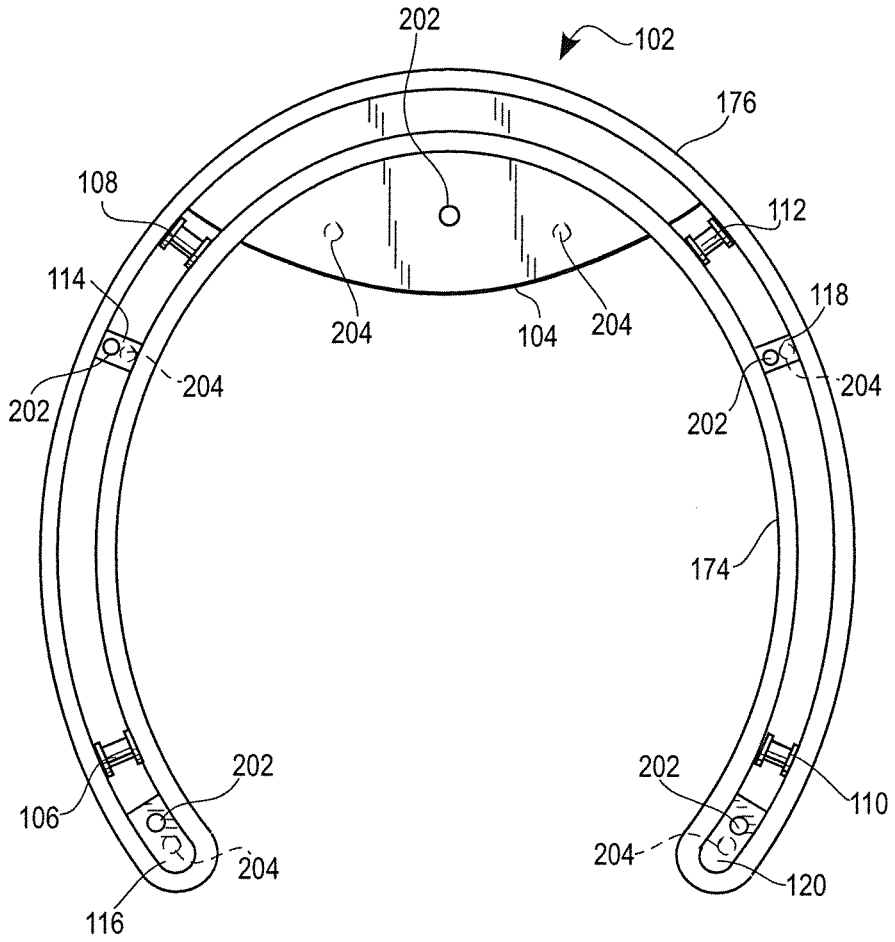
FIG. 2 is a plan view of a top horseshoe frame.

Referring next to FIG. 2, a plan view of the top horseshoe 102 of the adult walker 100 is shown. Shown are the top horseshoe 102, the top front plate 104, the left top front pivot attachment 108, the left top rear pivot attachment 106, the right top front pivot attachment 112, the right top rear pivot attachment 110, the left top front plate 114, the left top rear plate 116, the right top front plate 118, the right top rear plate 120, the top inner horseshoe rail 174, the top outer horseshoe rail 176, a plurality of top cover bolt shafts 202, and a plurality of eye hooks 204. Each eye hook is coupled to and extends vertically downward from one of the top plates 104, 106, 108, 118, 120. The left and right top plates 106, 108, 118, 120 have one eye hook each, with the eye hook approximately centered on the plate. The top front plate 104 has two eye hooks 204 that are approximately evenly spaced along the rear crescent of the top front plate 104 shape. The eye hooks 204 are used to attach a seat 206, a support belt 208 or other attachments. The top plates 104, 106, 108, 118, 120 also have one top cover bolt shaft 202 each. The top cover bolt shafts 202 are coupled to the top of the top plates 104, 106, 108, 118, 120 and extend upward vertically. The top cover bolt shafts 202 are located approximately centered on the left and right top plates 106, 108, 118, 120, but are not required to align with the location of the eye hooks 204. The top cover bolt shaft 202 coupled to the top front plate 104 is located along the line of symmetry of the horseshoe, approximately equidistant from the edge of the top horseshoe 102 and the edge of the top front plate 104. The top cover bolt shafts 202 are used to attach a frame cover, which is detailed below.

Figure 3:
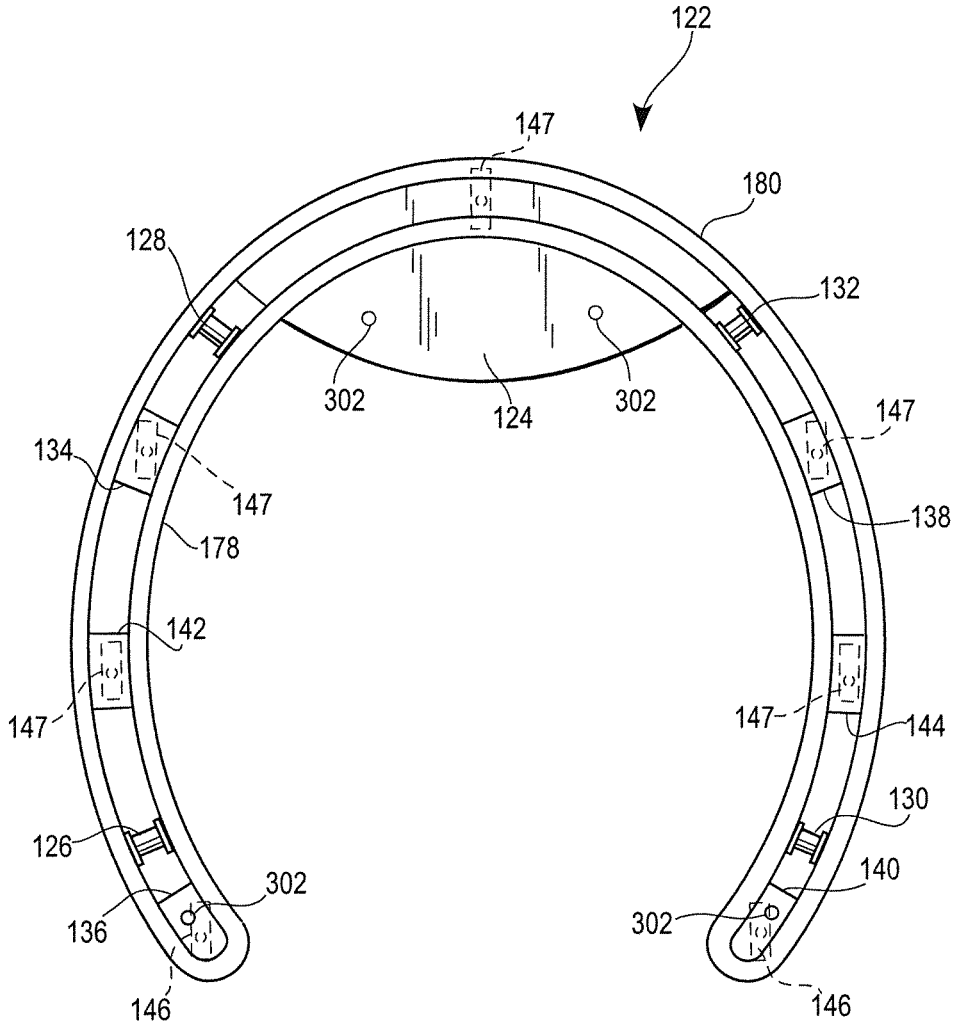
FIG. 3 is a plan view of a bottom horseshoe frame.

Referring next to FIG. 3, a plan view of the bottom horseshoe 122 of the adult walker 100 is shown. Shown are the bottom horseshoe 122, the bottom front plate 124, the left bottom front pivot attachment 128, the left bottom rear pivot attachment 126, the right bottom front pivot attachment 132, the right bottom rear pivot attachment 130, the left bottom front plate 134, the left bottom rear plate 136, the right bottom front plate 138, the right bottom rear plate 140, the left bottom middle plate 142, the right bottom middle plate 144, the plurality of locking wheels 146, the plurality of non-locking wheels 147, and a plurality of bottom cover bolt shafts 302. In this embodiment, two locking wheels 146 are shown. One locking wheel 146 is coupled to the underside of the left bottom rear plate 136, and the second locking wheel 146 is coupled to the underside of the right bottom rear plate 140. In this embodiment, five non-locking wheels 147 are shown. The wheels are coupled to the underside of the following plates 124, 134, 138, 142, 144, one wheel per plate: the bottom front plate 124, the left bottom front plate 134, the right bottom front plate 138, the left bottom middle plate 142 and the right bottom middle plate 144. The wheels are located approximately in the center of the plates 134, 138, 142, 144, with the exception of the non-locking wheel 147 coupled to the bottom front plate 124, which is located at the front of the walker frame, on the line of symmetry, and between bottom horseshoe rails 178, 180 forming the bottom horseshoe 122. The approximate wheel diameter for both locking and non-locking wheels 146, 147 is 3 inches. The bottom rear plates 136, 140 have one bottom cover bolt shaft each. The bottom cover bolt shafts 302 are coupled to the top of the bottom rear plates 136, 140 and extend upward vertically. The bottom cover bolt shafts 302 are located approximately centered on each bottom rear plate 136, 140, but are not required to align with the location of locking wheels 146. In this embodiment, two additional bottom cover bolt shafts 302 are coupled to the top of the bottom front plate 124 and are approximately evenly spaced along the rear crescent of the bottom front plate 124 shape. The bottom cover bolt shafts 302 are used to attach a plurality of bottom horseshoe covers 802, 804, 806 which are detailed below.

Figure 4:
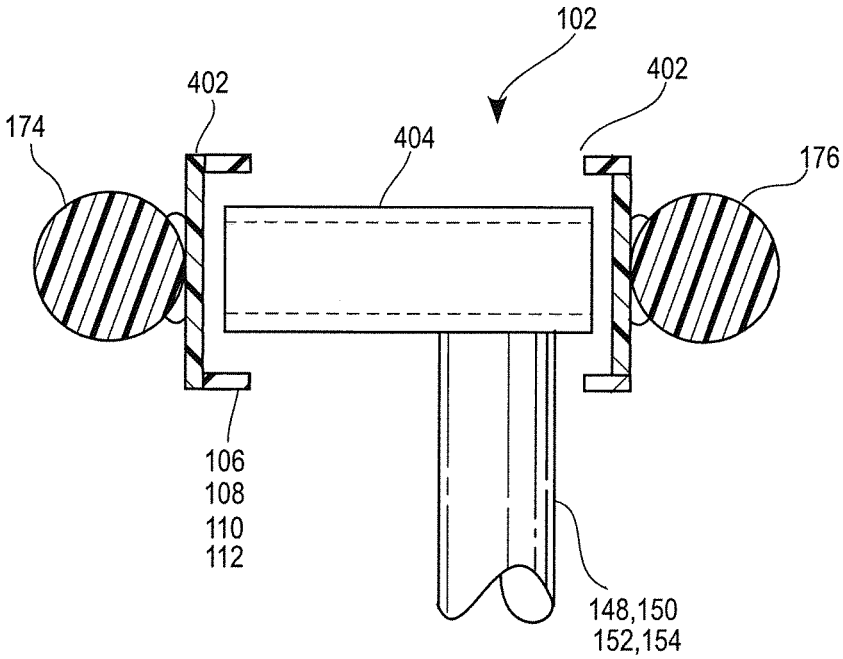
FIG. 4 is a detail of a top pivot attachment.

Referring next to FIG. 4, a detail of the top pivot attachment is shown. This detail applies to the left top front pivot attachment 108, the left top rear pivot attachment 106, the right top front pivot attachment 112, and the right top rear pivot attachment 110. Shown are the top horseshoe 102, a plurality of large pivot adjustment sleeves 402, and a small pivot adjustment rod 404. Also shown are the top inner horseshoe rail 174 and the top outer horseshoe rail 176. The top horseshoe 102 is shown in cross-section, i.e., the two rails 174, 176 comprising the horseshoe are shown in cross section and have the same horizontal centerline and a gap between them. The small pivot adjustment rod 404 is located horizontally between the top horseshoe rails 174, 176 but stops short of the inner edges of the horseshoe rails 174, 176. The centerline of the small pivot adjustment rod 404 is perpendicular to the centerlines of the top horseshoe rails 174, 176. Each end of the small pivot adjustment rod 404 fits inside the large pivot adjustment sleeve, which in turn is coupled to the adjacent top horseshoe rail 174, 176. Each large pivot adjustment sleeve 402 consists of an approximately diameter circular plate coupled to the end of a short piece of approximately ½" diameter tube. Each sleeve is coupled to the inside face of a top horseshoe rail 174, 176 with the tube portion perpendicular to the centerlines of the top horseshoe rails 174, 176 and open to the inside. Each end of the small pivot attachment rod 404 is coupled to a large pivot adjustment sleeve 402 so that the small pivot attachment rod is supported by the large pivot attachment sleeves 402 while still being able to rotate freely about its axis. One end of the outer rod 148, 160 or inner rod 150, 162 is coupled to the small pivot attachment rod 404.

Figure 5:
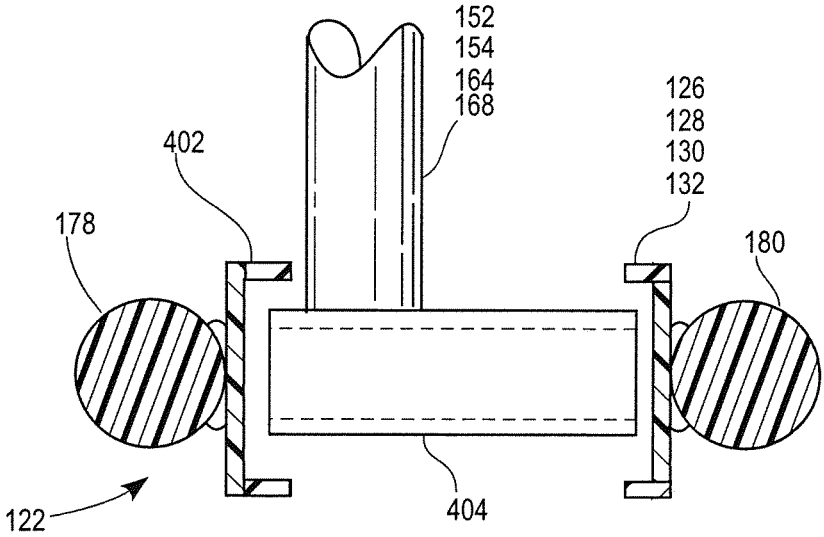
FIG. 5 is a detail of a bottom pivot attachment.

Referring next to FIG. 5, a detail of the bottom pivot attachment is shown. This detail applies to the left bottom front pivot attachment 128, the left bottom rear pivot attachment 126, the right bottom front pivot attachment 130, the right bottom rear pivot attachment 132. Shown are the bottom horseshoe 122, the plurality of large pivot adjustment sleeves 402, and the small pivot adjustment rod 404. Also shown is either the left bottom inner rod 154, the left bottom outer rod 152, the right bottom inner rod 168 or the right bottom outer rod 164. The structure and operation of the bottom pivot attachments 126, 128, 130, 132 is similar to that of the top pivot attachments 106, 108, 110, 112.

Figure 6:
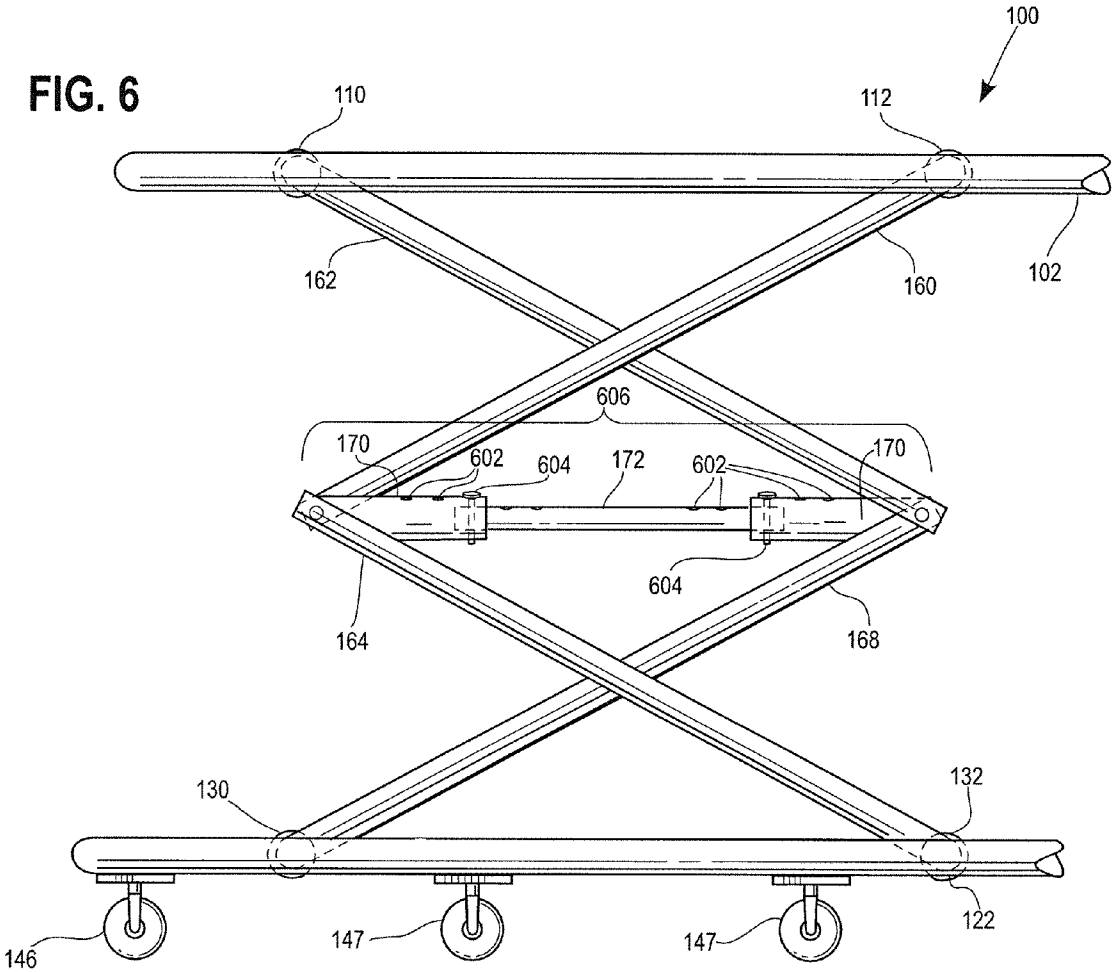
FIG. 6 is a side view of the adult walker frame.

Referring next to FIG. 6, an elevation of the right side of the adult walker 100 is shown. shown are the top horseshoe 102, the bottom horseshoe 122, the top right outer rod 160, the top right inner rod 162, the bottom right outer rod 164, the bottom right inner rod 168, the right top rear pivot attachment 110, the right top front pivot attachment 112, the right bottom rear pivot attachment 130, the right bottom front pivot attachment 132, the plurality of non-locking wheels 147, the locking wheel 146, the plurality of right outer tubes 170, the right inner tube 172, a plurality of vertical adjustment holes 602 and a plurality of lock pins 604. As described above, rods 160, 162, 164, 168 form a double-X which raises and lowers the top horseshoe 102 as the rods 160, 162, 164, 168 rotate about the pivot attachments 110, 112, 130, 132. The right inner and outer tubes 170, 172 form a right telescoping adjustment tube 606 (as previously shown in FIG. 1), located horizontally between the Xs. The plurality of vertical adjustment holes 602 are located at each right outer tube 170 end nearest the right inner tube 172 and each right inner tube 172 end nearest the right outer tube 170. The vertical adjustment holes 602 extend through both the top and bottom of the tubes 170, 172. At each end of the right inner tube 170 is the lock pin 604. At each side of the right inner tube 170, one vertical adjustment hole 602 in the right inner tube 170 is aligned with one vertical adjustment hole 602 in the adjacent right outer tube 172. The lock pin 604 is inserted through the holes 602 in both right tubes 170, 172, locking the length of the right telescoping adjustment tube 606 in place. As the adjustment holes 602 are used to lengthen the telescoping adjustment tube 606, the rods 160, 162, 164, 168 rotate and the double-X is reduced in height, lowering the top horseshoe 102. As the adjustment holes 602 are used to shorten the telescoping adjustment tube 156, 158, the rods 160, 162, 164, 168 rotate in the opposite direction and the double-X increases in height, raising the top horseshoe 102. The vertical adjustment may be used to adjust the height of the walker 100 for the user, or to fold the walker frame for transportation or storage. The left telescoping tube 182 on the left side of the walker operates similarly.

Figure 7:
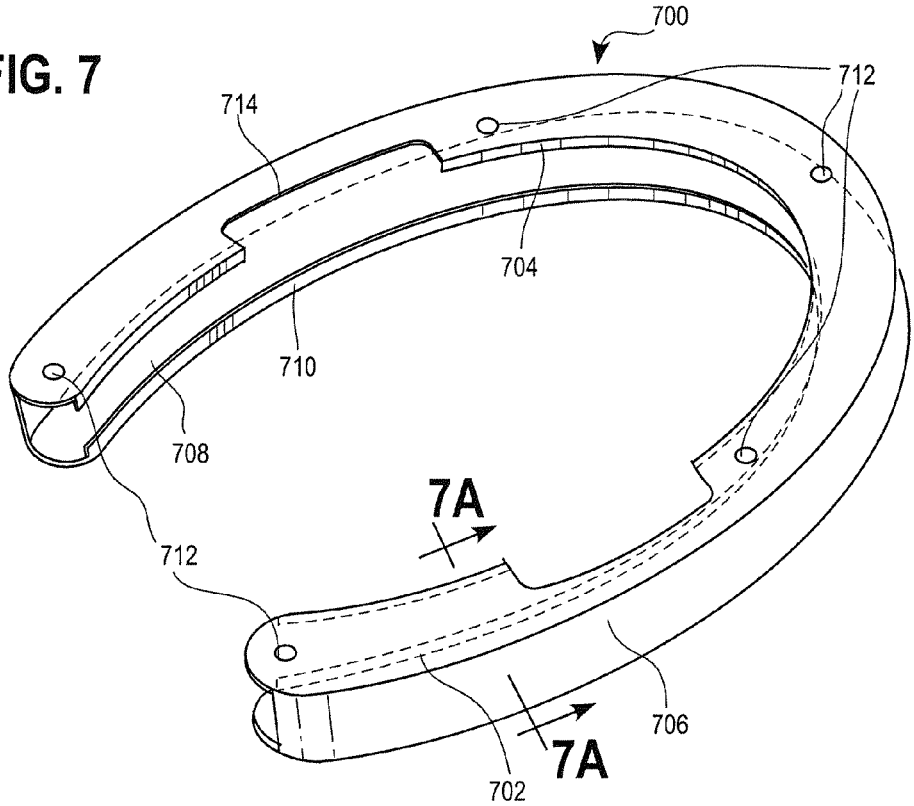
FIG. 7 is a perspective view of a top cover for the adult walker frame.
Figure 7A:
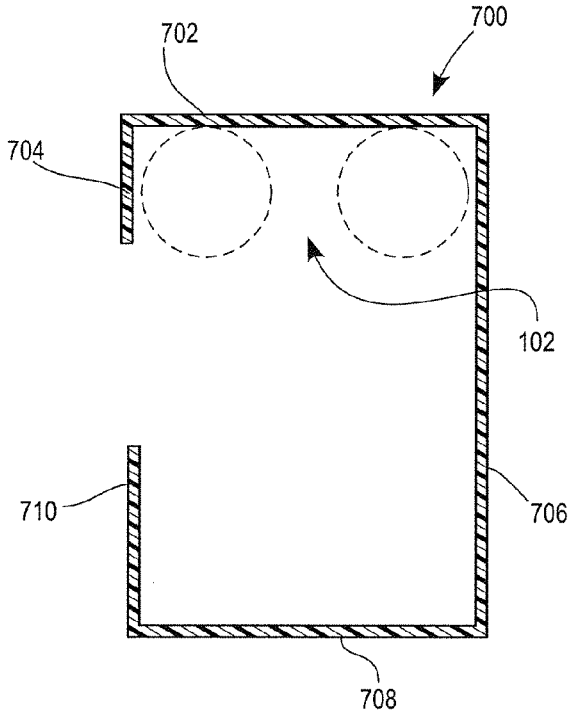
FIG. 7A is a cross-section view of the top cover for the adult walker frame.

Referring next to FIG. 7, a top horseshoe cover 700 is shown. The top horseshoe cover 700 includes a top cover top 702, a top cover top return 704, a top cover side 706, a top cover bottom 708, a top cover bottom return 710, a plurality of top cover bolt holes 712 and a plurality of grip indentations 714. The top cover top 702 is shaped to cover the top horseshoe 102 and provide a horizontal flat surface. The top cover top 702 overhangs the top horseshoe 102 in a sufficient dimension to be able to remove and replace the top horseshoe cover 700, while providing a secure fit to the top horseshoe 102. The width of the top cover top 702 is approximately 2.5 inches. The top cover side 706 is coupled to and extends down vertically from the outside edge of the top cover top 702. The width of the top cover side 706 is approximately 6 inches. The top cover top return 704 is coupled to and extends down vertically from the inside edge of the top cover top 702. The width of the top cover top return 704 is approximately 3 inches. The top cover bottom 708 is coupled to and extends horizontally from the top cover side 706 bottom edge, towards the inside of the top horseshoe 102. The width of the top cover bottom 708 is approximately 2.5 inches. The top cover bottom return 710 is coupled to the inside edge of the top cover bottom 708 and extends vertically upward approximately 3". The top horseshoe cover 700 essentially forms a continuous reverse channel shape that covers the top horseshoe 102, providing a smooth, continuous cover to the top horseshoe 102 on three sides. A section through the top horseshoe cover 700 is shown in FIG. 7A. The plurality of top cover bolt holes 712 are provided in locations to align with the top cover bolt shafts 202 when the top horseshoe cover 700 is in place. In one embodiment, the top cover bolt shafts 202 are threaded and a nut is used to secure the top horseshoe cover 700 to the top horseshoe 102. Along the sides of the top horseshoe cover 700, about halfway between the front and rear of the top horseshoe cover 700, a portion of the top horseshoe cover 700 is removed. For a length of approximately 12" on each horseshoe 102 side, the top cover top return 704 and approximately the inside half of the top cover top 702 are removed. This exposes the top horseshoe inner rail 174 for approximately a 12 inch length, allowing for the top horseshoe inner rail 174 to be gripped by the user for stability. In the preferred embodiment of the invention, the top horseshoe inner rail 174 exposures are located approximately halfway down the side of the top horseshoe 102 and are symmetrical about the top horseshoe 102 line of symmetry. In the preferred embodiment, the top horseshoe cover 700 is made of polyurethane.

Figure 8:
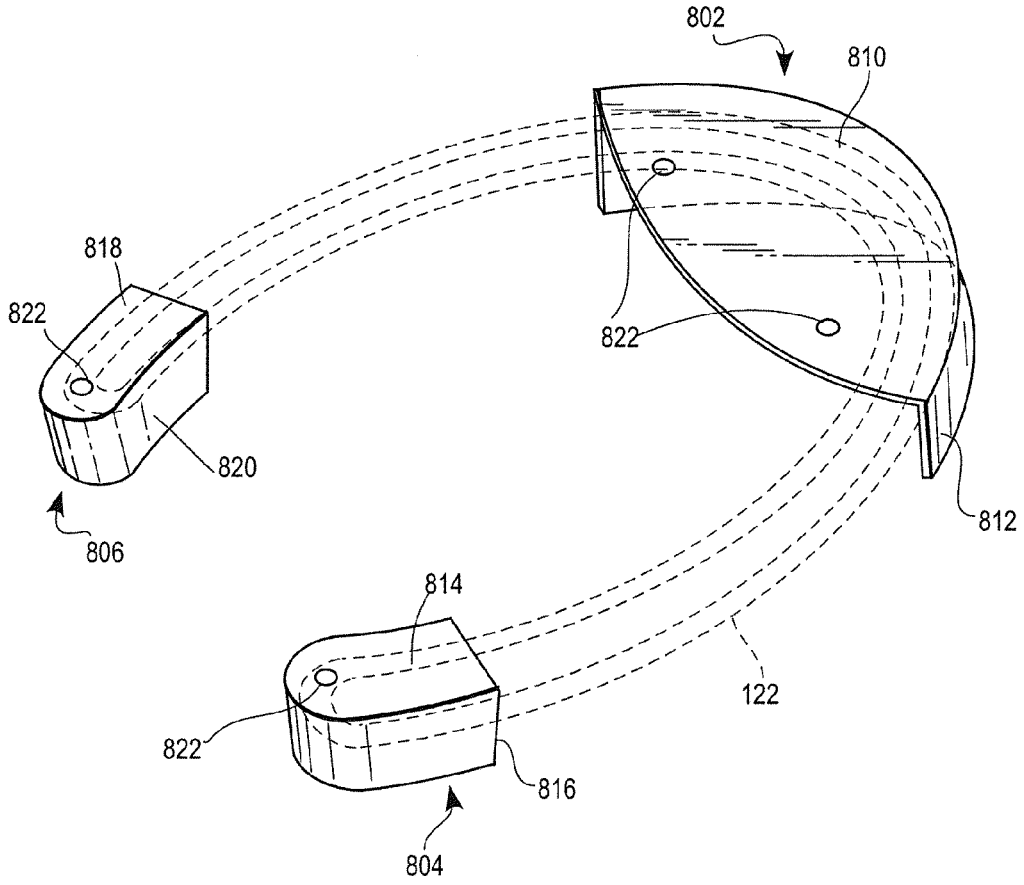
FIG. 8 is a perspective view of a bottom cover for the adult walker frame.

Referring next to FIG. 8, a bottom front horseshoe cover 802, a bottom right horseshoe cover 804 and a bottom left horseshoe cover 806 are shown according to one embodiment of the invention. The outline of the bottom horseshoe 122 is shown. The bottom front horseshoe cover 802 includes a bottom front cover top 810 and a bottom front cover side 812. The bottom right horseshoe cover 804 includes a bottom right cover top 814 and a bottom right cover side 816. The bottom left horseshoe cover 806 includes a bottom left cover top 818 and a bottom left cover side 820. Also shown are a plurality of bottom cover bolt holes 822. The bottom front cover top 810 is of shape and size to horizontally cover the bottom front plate 124 of the bottom horseshoe 122. The bottom front cover side 812 is coupled to and extends vertically downward from the front edge of the bottom front cover top 810. The vertical height of the bottom front cover side 812 is approximately 2.5 inches. The bottom right cover top 814 is of shape and size to horizontally cover the horseshoe right end as formed by the bottom horseshoe rails 178, 180 and the right bottom rear plate 140. The bottom right cover side 816 is coupled to and extends vertically downward from the edges of the bottom right cover top 814. The vertical height of the bottom right cover side 816 is approximately 2.5 inches. The bottom right cover side 816 starts near the outer front edge of the right bottom rear plate 140 and wraps around the outside of the bottom horseshoe 122, around the end of the horseshoe, and up the inside of the bottom horseshoe 122, stopping near the inner front edge of the right bottom rear plate 140. The bottom right cover side 816 thus forms a U-shape in plan. The bottom left horseshoe cover 806 is formed similarly to the bottom right horseshoe cover 804. The vertical sides of the bottom horseshoe covers 802, 804, 806 provide additional tipping prevention as the bottom horseshoe cover sides 812, 816, 820 will contact the floor when the adult walker 100 is rotated at a small angle relative to the floor, preventing the adult walker 100 from reaching an unstable angle.

Figure 9:
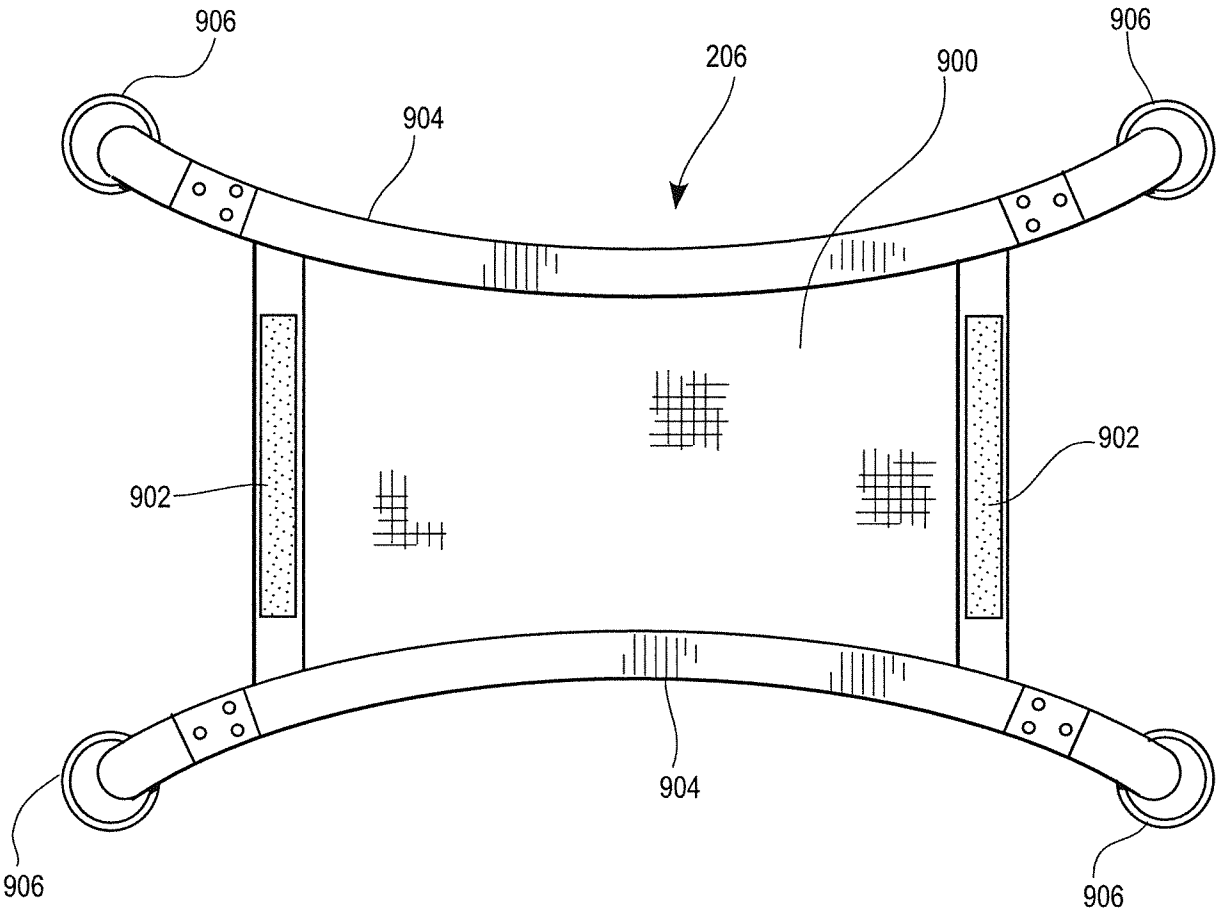
FIG. 9 is a plan detail of a seat.

Referring next to FIG. 9, an adult walker seat 206 in one embodiment is shown. Shown is a seat cushion 900, a plurality of loop or hook fastener tape strips 902, a plurality of seat support straps 904 and plurality of seat attachment rings 906. The seat cushion 900 is approximately rectangular in shape. On each side of the seat cushion 900, the seat support strap 904 is coupled to the seat cushion 900 and extends past the front and back of the seat cushion 900. The seat attachment ring 906 is coupled to each end of each strap, for a total of four rings. The seat 206 is attached to the adult walker 100 by using a plurality of carabiners to couple each seat attachment ring 906 to one of the eye hooks 204 on the top horseshoe 102. At the front of the seat cushion 900, the loop or hook fastener tape strip 902 is coupled to the top of the seat cushion 900. At the back of the seat cushion 900, the loop or hook fastener tape strip 902 is coupled to the top of the seat cushion 900. The seat cushion 900 is cushioned and in the preferred embodiment has a disposable nylon cover. The seat support straps 904 are made of leather, nylon or other suitable material.

Figure 10:
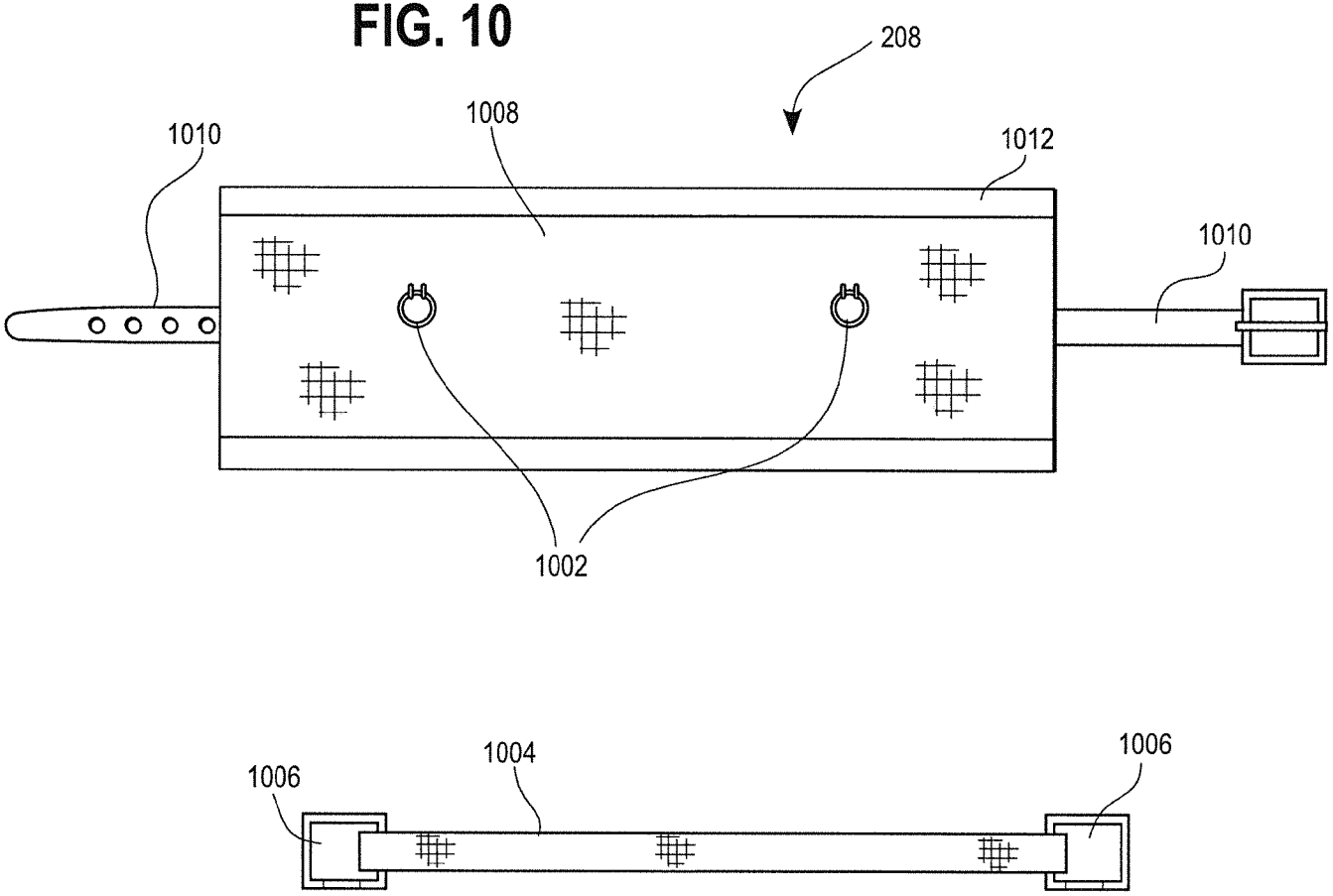
FIG. 10 is a detail of a support belt.

Referring next to FIG. 10, the adult walker 100 support belt 208 is shown. Shown are the belt 208, a plurality of belt rings 1002, a belt attachment 1004 and a plurality of belt carabiner attachments 1006. A middle belt portion 1008 of the support belt 208 is approximately 6 inches wide. A plurality of adjustable ends 1010 of the belt 208 are approximately 1-2 inches wide. Two belt rings 1002 are shown coupled to the middle portion 1008 of the outside of the support belt 208. A belt cushion 1012 is coupled to the inside of the middle belt portion 1008. The belt cushion 1012 in the preferred embodiment is approximately 8 inches wide, extends the full length of the middle belt portion 1008 with equal overhang above and below the middle belt portion 1008, and includes ½ inch foam covered with vinyl. The belt attachment 1004 is a strip approximately 10 inches long with the carabiner attachment 1006 on each end. One end of the belt attachment 1004 is coupled to one of the eye hooks 204 on the top horseshoe 102 and the other end is coupled to one of the belt rings 1002. When the support belt 208 is worn by the user, the attachment of the support belt 208 to the top horseshoe 102 will support the user in case of a fall, while the 6 inch belt width will help prevent back injury.

Figure 11:
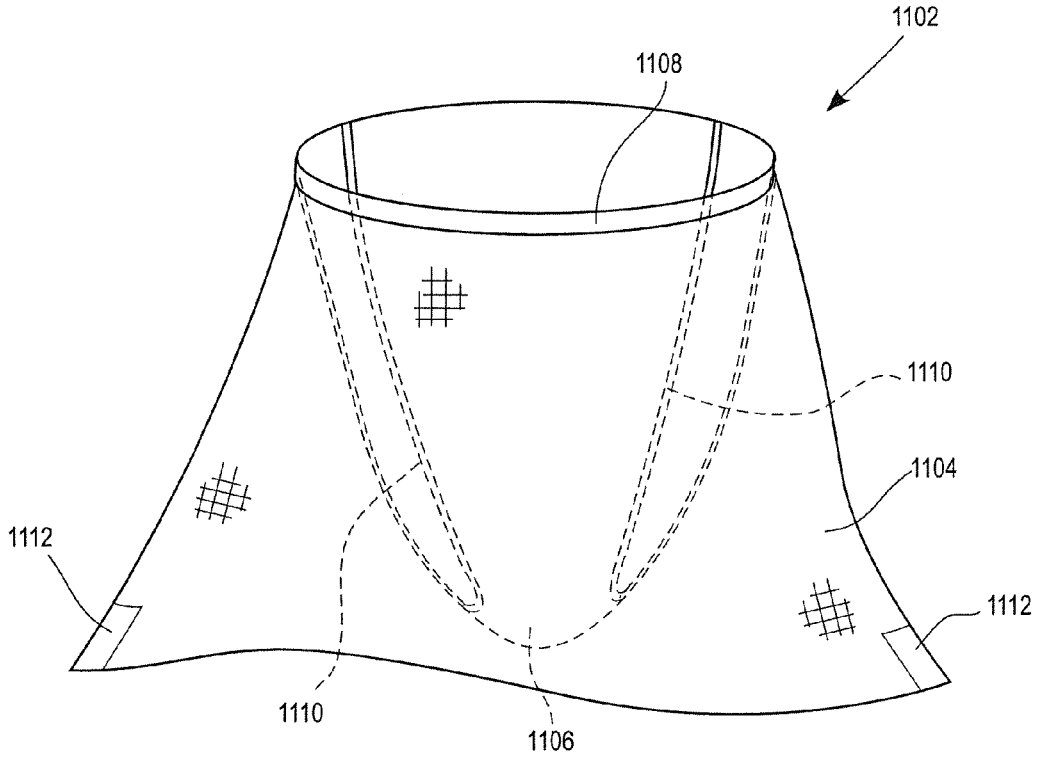
FIG. 11 is a detail of an incontinence garment.

Referring next to FIG. 11, an incontinence garment 1102 is shown. Shown is a fabric apron 1104, an excrement bag 1106, an elastic waist band 1108, a plurality of elastic crotch bands 1110 and a plurality of hook or loop tape fastener strips 1112. The elastic waist band 1108 is circular and fits around the user's waist. The fabric apron 1104 is shaped like a truncated cone, with the narrow end of the cone continuously coupled to the elastic waist band 1108. On the right side, one end of the elastic crotch band 1110 is coupled to and extends from the front right side of the elastic waist band 1108, down in a U-shape with the bottom of the U at the user's crotch level, and back up to the rear right side of the elastic waist band 1108, where it is coupled to the elastic waist band 1108. The elastic crotch band 1110 on the left side is similar. Between the elastic crotch bands 1110 is the excrement bag 1106, which is continuously coupled on each side to the elastic crotch bands 1110, at the front to the front of the elastic waist band 1108, and at the rear to the rear of the elastic waist band 1108. The excrement bag 1106 may be made of plastic or other suitable material. The hook or loop tape fastener strip 1112 is coupled to the bottom edge of the fabric apron 1104 on each side. The incontinence garment 1102 prevents soiling of the user, seat 206 or walker 100 due to incontinence, while providing for the modesty of the user. The hook or loop tape fastener strip 1112 on each side of the incontinence garment 1102 may be attached to the corresponding loop or hook tape 902 on the seat 206, securing the incontinence garment 1102 in place.

While the invention herein disclosed has been described by means of specific embodiments, examples and applications thereof, numerous modifications and variations could be made thereto by those skilled in the art without departing from the scope of the invention set forth in the claims.

What is claimed is:

1. An apparatus comprising:

an upper frame adapted to at least partially encircle a person;

a lower frame adapted to at least partially encircle the person;

a first scissor mechanism coupled to the upper frame;

a second scissor mechanism coupling the first scissor mechanism to the lower frame, wherein a distance between the upper frame and the lower frame can be varied by adjusting the first scissor mechanism and the second scissor mechanism;

a plurality of attachments coupled to said upper frame; and a seat coupled to the plurality of attachments via a plurality of straps.

2. An apparatus comprising:

an upper frame;

a lower frame;

a first scissor mechanism coupled to the upper frame;

a second scissor mechanism coupling the first scissor mechanism to the lower frame, wherein a distance between the upper frame and the lower frame can be varied by adjusting the first scissor mechanism and the second scissor mechanism;

at least four wheels coupled to the lower frame;

a seat removably coupled to at least one support element selected from the group consisting of: the upper frame, the lower frame, the first scissor, the second scissor, wherein a seat elevation is located between the upper frame and the lower frame; and a lower frame cover coupled to the lower frame, wherein the seat elevation, the lower frame cover, and the at least four wheels are configured to provide stability against the apparatus reaching an unstable angle with respect to a floor when a person is seated in the seat.

3. The apparatus of claim 2 further comprising:

a plurality of attachments coupled to the upper frame, wherein the seat is coupled to the upper frame via the plurality of attachments.

4. The apparatus of claim 3 further comprising:

a plurality of straps each coupled to one of the plurality of attachments, wherein the seat is coupled to the upper frame via the plurality of attachments.

5. The apparatus of claim 2 wherein the upper frame is adapted to partially encircle the person.

6. The apparatus of claim 2 wherein the lower frame is adapted to partially encircle the person.

7. The apparatus of claim 2, the seat further comprising a seat cushion.

8. The apparatus of claim 2, further comprising an upper frame cover coupled to the upper frame.

* * * * *